United States Patent [19]

Kapuscinski

[11] 4,163,515

[45] Aug. 7, 1979

[54] DISPOSABLE STAPLER APPARATUS AND METHODS OF CONSTRUCTING AND UTILIZING SAME

[76] Inventor: Peter R. Kapuscinski, 4117 Connie Dr., Sterling Heights, Mich. 48077

[21] Appl. No.: 838,382

[22] Filed: Sep. 30, 1977

[51] Int. Cl.[2] ..... B25C 5/00

[52] U.S. Cl. ..... 227/120

[58] Field of Search ..... 227/120, 124, 134

[56] References Cited

U.S. PATENT DOCUMENTS

| | | | |
|---|---|---|---|
| 2,331,509 | 10/1943 | Scheckwitz | 227/120 |
| 2,381,192 | 8/1945 | Vancura | 227/124 |
| 2,632,889 | 3/1953 | Beecroft | 227/120 |
| 3,083,367 | 4/1963 | Ruskin | 227/134 X |
| 3,583,622 | 6/1971 | Graeff | 227/120 |

*Primary Examiner*—Gerald A. Dost
*Assistant Examiner*—Paul A. Bell
*Attorney, Agent, or Firm*—Irving M. Weiner; Pamela S. Austin; Melvin Yedlin

[57] ABSTRACT

A disposable stapler apparatus adapted to be disposed of after a set of staples contained therein have been individually dispensed. The apparatus includes a staple magazine having a set of staples predisposed therein, the magazine being adapted to be substantially closed so as to be non-refillable. The staple magazine is adapted to cooperate in a conventional manner with a base so as to perform a conventional stapling operation on sheet material placed between the base and the magazine.

10 Claims, 4 Drawing Figures

DISPOSABLE STAPLER APPARATUS AND METHODS OF CONSTRUCTING AND UTILIZING SAME

BACKGROUND OF THE INVENTION

1. Field of the Invention

The present invention relates generally to a stapler apparatus which is adapted to be disposable in its entirety after a predisposed set of staples have been individually dispensed therefrom.

In particular, the present invention relates to a stapler apparatus including a staple magazine which is adapted to be non-refillable and is provided with a single set of staples for dispensing.

2. Description of the Prior Art

One of the most commonly employed articles for use in office situations, as well as for use in the home, is a stapler device. Heretofore, a wide variety of different stapler constructions has been suggested and employed for use, all of which constructions are marked by the common feature of including a staple magazine which is adapted to be refilled such that when the magazine is empty the user has to insert a fresh set of staples for use.

Illustrative of prior art staplers are the following: the "RAISER STRUCTURE FOR STAPLING MACHINES" disclosed in U.S. Pat. No. 2,706,292 issued in 1955 to Moen; the "STAPLE DRIVING DEVICE" disclosed in U.S. Pat. No. 2,824,307 issued in 1958 to Marano; the "COMBINATION STAPLER TOOLS" disclosed in U.S. Pat. No. 2,859,443 issued in 1958 to Jopp; and the "UPRIGHT STAPLER" disclosed in U.S. Pat. No. 3,987,951 issued in 1976 to Thornhill.

As mentioned above, previous stapler constructions have all been refillable. Such refillable feature, however, presents the following problems. For refilling the stapler, staples are conventially provided in joined together elongated sets which are adapted to be inserted and aligned within the staple magazine of the stapler. Such staple sets come in various lengths, and ofttimes the sets must be broken and/or pieced together to form different lengths thereof to accommodate different sized staplers and staple magazine constructions. Because the sets of staples comprise staples which are joined together so as to be easily individually dispensed within the staple magazine, the staple sets are thereby easily broken into smaller segments and are consequently awkward to handle. Indeed, in many instances, upon attempting to insert and align the set of staples within the staple magazine, the staples will become undesirably separated at various points, thus greatly complicating the entire procedure and sometimes resulting in waste pieces of staple sets which are too small to be easily inserted into the staple magazine. Further, because various stapler devices are adapted to house and dispense a variety of different sized staples, problems can also be encountered in purchasing and installing the proper sized staples.

As a result of the foregoing considerations, many people find refilling of a stapler to be a nuisance. As mentioned above, the staples are ofttimes difficult and troublesome to refill into the magazine, and indeed it is possible to inflict injury to oneself by the sharp points on the staples. Further, especially in smaller stapler constructions, alignment of the staples within the magazine is difficult and many staples are sometimes wasted in attempting to align the staples and testing the alignment with trial stapler operations.

The present invention eliminates the many problems associated with prior art stapler devices by providing a stapler apparatus which is completely self-contained in that it has predisposed therein a set of staples for individual dispensing. When the set of staples has been completely dispensed, the user has merely to discard the apparatus and thereafter employ another stapler apparatus in accordance with the invention. In addition, because the staples are predisposed within the magazine and are aligned therein, former refill alignment operations are no longer necessary. Thus, the troublesome features formerly associated with refillable staplers are entirely avoided, and the user is provided with a far more conveniently employed stapling tool.

SUMMARY OF THE INVENTION

The present invention provides a stapler apparatus of the type comprising an elongated base member and an elongated staple magazine member pivotably secured together adjacent first ends of the members. Means are provided cooperating with the members for biasing the members in opposite directions relative to each other. The magazine member is provided at a second end thereof with staple dispensing means and the base member is provided at a second end thereof with a plate member, the plate member and the staple dispensing means being adapted to cooperate to permit individual ones of the staples to be dispensed toward and against the plate member to perform a stapling operation when the members are pivoted toward each other. The improvement in accordance with the present invention provides for a magazine member having a set of staples predisposed and aligned therein, with the magazine member being adapted to be non-refillable and the apparatus being adapted to be disposed of after the predisposed set of staples has been completely dispensed.

It is an object of the invention to provide an apparatus wherein stapling functions may be easily performed, without the necessity of having to refill the apparatus, and wherein the apparatus is adapted to be disposed of after a single set of predisposed staples within the staple magazine member have been individually dispensed.

Other details and objects of the invention will become apparent from the following description, when read in conjunction with the accompanying drawings.

DETAILED DESCRIPTION OF PREFERRED EMBODIMENTS

Figure 1:
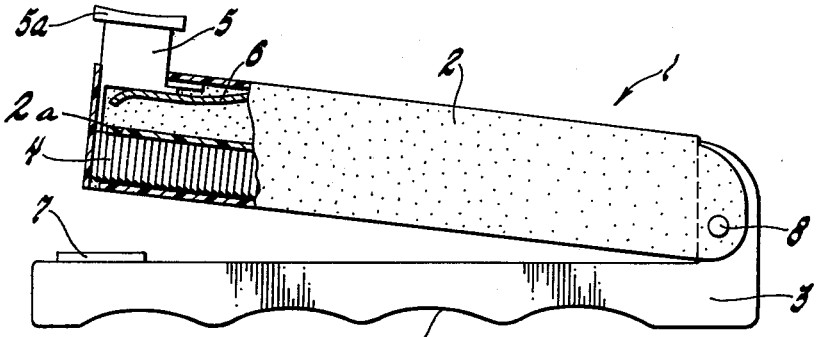
FIG. 1 depicts a side elevational view of one embodiment of the disposable stapler apparatus according to the invention.

With reference to FIG. 1, there is depicted generally a disposable stapler apparatus 1. The stapler 1 includes an upper elongated staple magazine member 2, to which is pivotably secured at a first end thereof a first end of an elongated base member 3. The magazine 2 comprises a substantially integral rectangular-cross sectioned housing portion which has been partially broken away in the drawing so as to view the interior thereof. As depicted, there is provided within the magazine 2 a set of staples 4, which are predisposed within the magazine 2. The set of staples 4 are substantially co-extensive with the length of magazine 2, and are biased toward a second end of the magazine 2 by conventional spring retainer means (not shown), and retained by hold-down bar 2*a*, which is irremoveably affixed and made integral with magazine 2. Disposed adjacent the second end of the magazine 2 is a knob member 5. The knob 5 comprises an upper handle portion 5*a*, as well as a lower staple dispensing plate 5*b*. The knob 5 is biased upwardly against the inner surface of the top wall of magazine 2 by means of a spring 6. The spring 6 is flexible to permit downward movement of knob 5 towards base 3 when a suitable force is applied to handle portion 5*a* by the user.

The base 3 is provided with a striker plate 7 which is adapted in a known manner with a recessed portion (not shown) against which a staple will be forced into a conventional bent stapled condition. The base 3 is riveted at 8 to the magazine 2 adjacent the first ends of the two members in a manner such that the two members are normally biased away from each other as shown. Also provided in base 3 is a finger-grip portion 3*a* which includes four indentations which can be easily gripped by the fingers of the user.

In operation, the user has merely to apply a downward force to handle portion 5*a*, thus causing the magazine 2 to pivot downwardly towards base 3, and causing the plate 5*b* of knob 5 to travel downwardly within magazine 2, thus forcing a first staple downwardly against striker plate 7 to perform the desired stapling operation. It should be noted that the pivotable connection at 8 can also be adapted to permit the magazine 2 to be swung away from base 3, through substantially a 180° angle, to thus permit a staple-tacking operation wherein staples are applied directly such as to a wall surface, without cooperation with striker plate 7.

It should be particularly noted that the housing portion of magazine 2 is substantially closed, and the magazine 2 with predisposed staples 4 constitutes a self-contained unit. In this connection, it can be seen that magazine 2 is non-refillable, and when the quantity of staples 4 has been dispensed, the magazine 2 will be empty and not capable of being refilled. At this point, the stapler apparatus 1 is merely discarded, and another apparatus 1 is employed in its stead. To this end, the stapler apparatus 1 is fabricated of inexpensive and preferably lightweight material, such as rigid plastic, or light metal, however, various desired portions, such as striker plate 7, may be made of more rugged material if desired.

Figure 2:
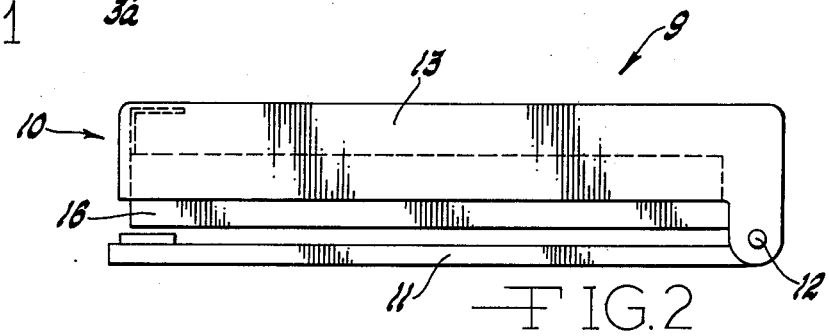
FIG. 2 illustrates a side elevational view of another embodiment of a disposable stapler apparatus.
Figure 4:
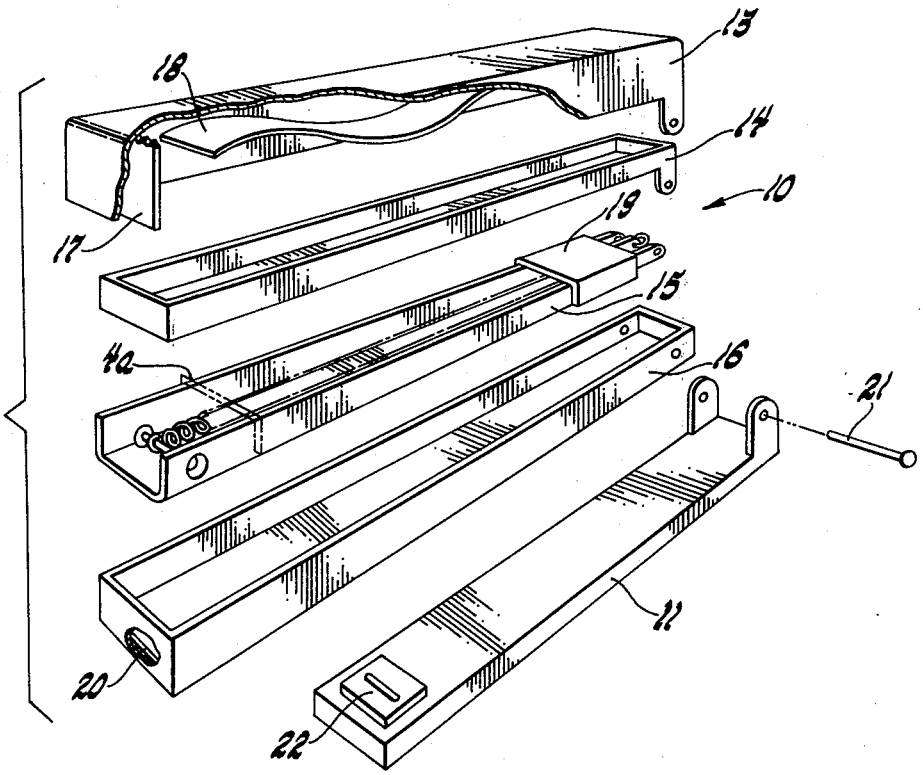
FIG. 4 illustrates a view of the construction of the disposable stapler apparatus depicted in FIG. 2.

Referring now to FIG. 2, a second embodiment of the disposable stapler apparatus is shown. The stapler apparatus 9 includes a magazine 10 and base 11. The magazine 10 and base 11 are pivotably secured together at 12 in much the same manner as described hereinabove regarding stapler apparatus 1. The general construction of stapler apparatus 9 can be more easily understood with reference to FIG. 4, wherein the various parts of stapler apparatus 9 are shown separated for clarity of understanding. The magazine 10 is shown as including an upper case portion 13, a staple hold down bar 14, a staple retaining portion 15, and a lower case portion 16. The upper case 13 is provided therein with an elongated spring 18, and a staple dispensing plate 17. The staple retainer 15 is provided with a spring-controlled staple pusher plate 19 adapted to bias a set of staples 4 forwardly towards the second end thereof, as shown by the single staple 4*a*. The retainer 15 is adapted to be disposed within the lower case 16, engaged by slot 20. In turn, the hold down bar 14 will fit over the retainer 15 and will in turn be received within upper case 13 so as to provide the general magazine configuration depicted in FIG. 2. The various components of magazine 10 are adapted to cooperate so as to substantially prevent separation thereof, and the bar 14, retainer 15, and lower case 16 may be affixed together such as by adhesive or welding at various portions thereof. The magazine 10 as formed by the various components is adapted to be pivotably secured to base 11 by means of rivet 21 as shown in FIG. 4.

The base 11 is provided with a striker plate 22 adapted to cooperate to bend staples in much the same manner as above described with regard to striker plate 7 of stapler apparatus 1. In use, upon a downward pressure being applied to the upper surface of upper case 13, the upper case 13 will travel downwardly with respect to lower case 16, against the action of spring 18. The staple dispensing plate 17 will thus cause an individual staple to be forced downwardly against striker plate 22, and the stapling operation will be completed, with the various members returning to their original position as normally biased. Hereagain, it is important to note that the magazine 10 is adapted so as to be completely non-refillable, and when the predisposed set of staples 4 have been completely dispensed, the apparatus 9 is then discarded, rather than refilled.

Figure 3:
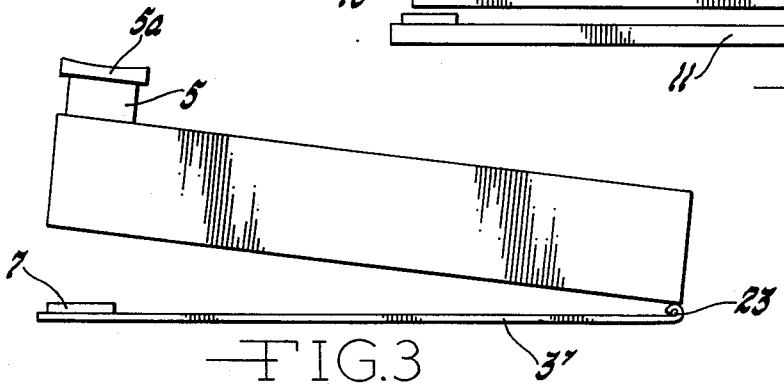
FIG. 3 depicts a side elevational view of a further embodiment of a disposable stapler apparatus.

With reference to FIG. 3, an embodiment of the disposable stapler is depicted, which embodiment bears resemblance to the FIG. 1 embodiment. In this embodiment, however, the base member 3' is shown as substantially flat, without any finger-grip portions. In addition, rather than the connection 8, a hinge 23 is employed for pivotably securing the two members together such as to maintain same in a normally biased-away from each other condition. The FIG. 3 embodiment is similar to that of FIG. 1 in other respects, and functions in substantially the same manner.

As described above, the stapler apparatus in accordance with the invention may be of various configurations, however the common essential feature of each configuration is the non-refillable staple magazine provided and the general disposable feature of the apparatus. As set forth above, such disposable feature is highly desirable in overcoming many problems formerly associated with refillable stapler devices. In addition, the stapler apparatus in accordance with the invention, regardless of its particular configuration, is provided with a set of predisposed staples which are properly aligned within the staple magazine. Further, the stapler apparatus is constructed of substantially lightweight and inexpensive plastic or other material.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

I claim:

1. In a stapler apparatus of the type comprising an elongated base member and an elongated staple magazine member pivotably secured together adjacent first ends of said members; means cooperating with said members for biasing said members in opposite directions relative to each other; said magazine member being provided at a second end thereof with staple dispensing means; said base member being provided at a second end thereof with a plate member; and said plate member and said staple dispensing means being adapted to cooperate to permit individual ones of said staples to be dispensed toward and against said plate member to perform a stapling operation when said members are pivoted toward each other, the improvement wherein:

said magazine member has a set of staples predisposed and aligned therein;

said set of staples being retained by a bar member superposed on said set of staples;

said bar member being immoveably affixed within said magazine member so that removing said bar member to insert a second set of staples is prevented.

2. A stapler apparatus in accordance with claim 1, wherein:

said base member and said staple magazine member are pivotably secured together to permit said staple magazine member to be selectively swung away from said base member to permit said staples to be individually dispensed without cooperating with said plate member on said base member.

3. A stapler apparatus in accordance with claim 1, wherein:

said staple magazine member has provided adjacent an upper surface thereof a spring-retained knob member, said knob member being adapted to be pressed toward said base member and being provided with means for individually dispensing said staples toward and against said plate member.

4. A stapler apparatus in accordance with claim 1, wherein:

a lower surface of said base member is provided with a finger-grip portion adapted to be engaged by the fingers of the user of said apparatus.

5. A stapler apparatus in accordance with claim 1, wherein:

said base member and said staple magazine member are pivotably secured together by a hinge member adapted to bias said members in opposite directions relative to each other.

6. A stapler apparatus in accordance with claim 5, wherein:

said staple magazine member has provided adjacent an upper surface thereof a spring-retained knob member, said knob member being adapted to be pressed toward said base member and being provided with means for individually dispensing said staples toward and against said plate member; and said spring-retained knob member is biased away from said base member.

7. A stapler apparatus in accordance with claim 6, wherein:

said staple magazine member comprises a substantially integral housing portion including a lower wall which faces said base member, a pair of side walls, and an upper wall for supporting said knob member; and said knob member is spring retained and biased away from said base member by means of a spring member disposed within said housing to bias said knob member against and outwardly from an inner surface of said upper wall of said housing portion.

8. A stapler apparatus in accordance with claim 1, wherein:

said staple magazine member includes a lower case portion and an upper case portion, said upper case portion being slightly biased away from said lower case portion by means of a spring disposed within said upper case portion.

9. A stapler apparatus in accordance with claim 8, wherein:

said staple hold down bar cooperates with a staple retaining portion and said lower case portion and is disposed intermediate said upper case portion and said lower case portion for properly aligning said predisposed set of staples within said magazine member; and said lower case portion, said staple retaining portion, and said staple hold down bar are secured together so as to substantially prevent separation thereof.

10. A stapler apparatus in accordance with claim 1, wherein:

said apparatus is substantially constructed of substantially rigid plastic.

* * * * *